US006123140A

United States Patent [19]

Bergamaschi

[11] Patent Number: 6,123,140

[45] Date of Patent: Sep. 26, 2000

[54] SPRING DEVICE FOR ROLLING UP A ROLLER CURTAIN

[75] Inventor: Giovanni Bergamaschi, Bologna, Italy

[73] Assignee: Sunproject S.r.l., Cadriano Di Granarola, Italy

[21] Appl. No.: 09/194,291

[22] PCT Filed: May 20, 1997

[86] PCT No.: PCT/IB97/00571

§ 371 Date: Nov. 23, 1998

§ 102(e) Date: Nov. 23, 1998

[87] PCT Pub. No.: WO97/44562

PCT Pub. Date: Nov. 27, 1997

[51] Int. Cl.[7] ..... A47G 5/02

[52] U.S. Cl. ..... 160/316; 160/318; 185/13; 185/43

[58] Field of Search ..... 160/313, 316, 160/317, 318, 323.1; 185/13, 43; 242/372, 379.1

[56] References Cited

U.S. PATENT DOCUMENTS

| | | | |
|---|---|---|---|
| 310,658 | 1/1885 | Eddy | 160/316 |
| 982,444 | 1/1911 | Smith | 185/13 |
| 1,132,830 | 3/1915 | Cole | 160/316 |
| 3,190,394 | 6/1965 | Gublemann | 185/43 |
| 3,735,840 | 5/1973 | Shepard | 185/43 |
| 4,215,830 | 8/1980 | Cunningham | 242/372 |
| 4,483,494 | 11/1984 | Takada | 242/372 |
| 5,137,073 | 8/1992 | Huang | 160/323.1 |
| 5,201,897 | 4/1993 | Whiting . | |
| 5,535,959 | 7/1996 | Hamann et al. | 242/372 |
| 5,558,293 | 9/1996 | Hirase et al. | 242/372 |
| 5,775,619 | 7/1998 | Tabellini | 242/372 |
| 5,964,426 | 10/1999 | Tabellini | 242/372 |

FOREIGN PATENT DOCUMENTS

| | | | |
|---|---|---|---|
| 0058 883 | 2/1982 | European Pat. Off. . | |
| 0628 687 | 11/1993 | European Pat. Off. . | |
| 3523290 | 1/1986 | Germany . | |
| 1068583 | 1/1984 | U.S.S.R. | 160/313 |
| 222936 | 10/1924 | United Kingdom . | |
| 2151678 | 7/1985 | United Kingdom | 160/313 |

*Primary Examiner*—Blair M. Johnson
*Attorney, Agent, or Firm*—William J. Sapone, Esq.; Nims, Howes, Collison Hanson & Lackert

[57] ABSTRACT

Elastic means for rolling up a roller curtain include a plurality of springs (26,27,28) fastened rigidly to a common support (15) connected to a shaft (2) and with respective support and constraint elements (36,37,38) which are geometrically coupled to the roller (19). A device for connecting the springs to a stationary frame (35) of the curtain (20) reduces the number of springs torsional turns with respect to the number of turns of the roller (19) by interposition of a speed reducer between the shaft (2), to which the springs are fastened, the stationary frame (35) and the roller (19). The shaft (2) end is located closer to the most external support and constraint element (36) and its extremity has a disc (11) mounted thereto. The coupling device together with the springs (50), their supports (15,36,37,38), the shaft (2) and an external support cylindrical body (6) form a compact assembly, which is introduced into one head of the roller (19). The other head of the roller (19) features a cap (12), rotatably fastened to a cylindrical section of a support (13) which is locked to the stationary frame (35) by a tang (14). The geometrical coupling between the shaft (2) and the spring supports (15,36,37,38) allows for easy and quick relocation of the roll up device on each side of the window to which the roller curtain is to be mounted.

6 Claims, 4 Drawing Sheets

FIG.4
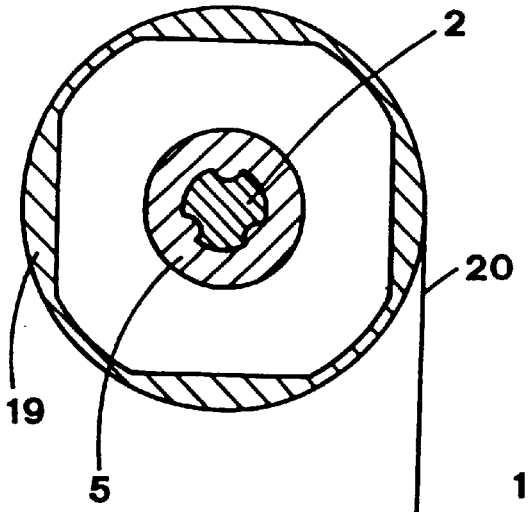
FIG.3
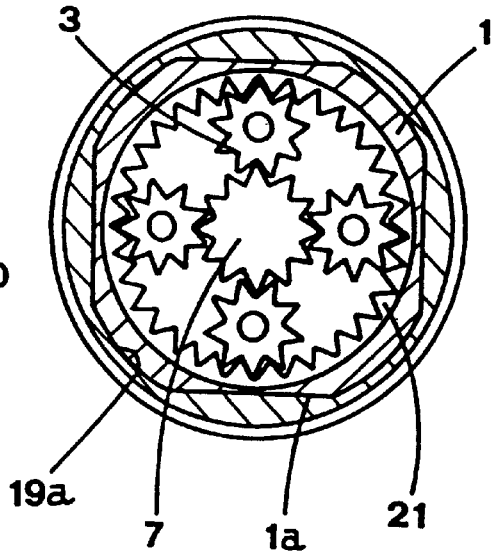
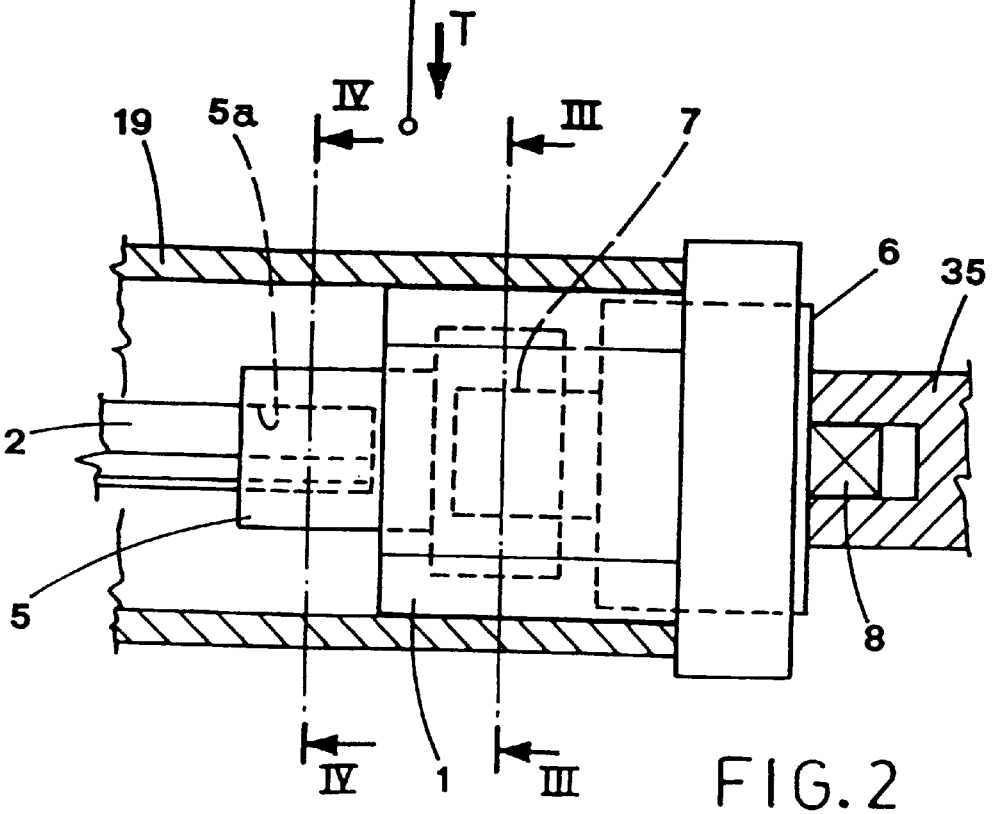
FIG.2

FIG. 9
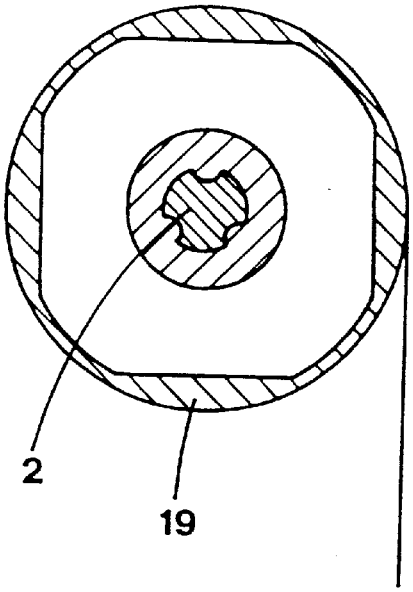
FIG. 10
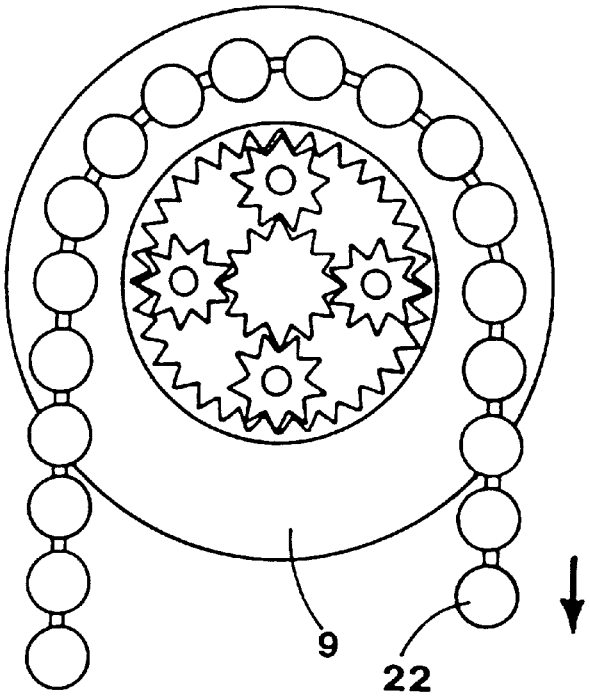
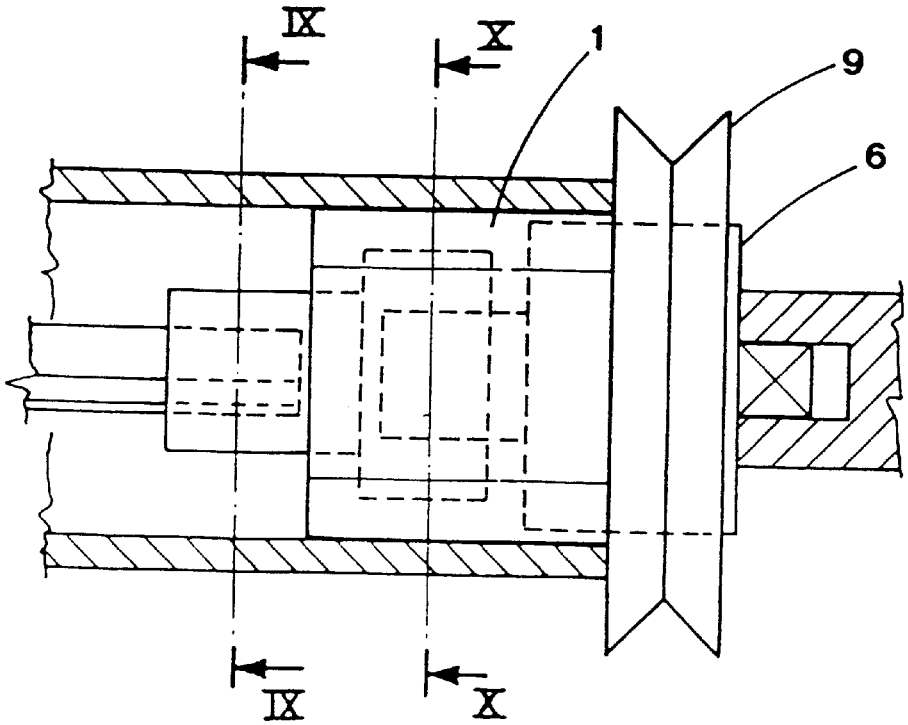
FIG. 8

SPRING DEVICE FOR ROLLING UP A ROLLER CURTAIN

BACKGROUND OF THE INVENTION

The present invention relates to production of roller curtains or the like, which are applied to windows for darkening, for preventing insects from entrance, and the like.

In particular, the present invention concerns configuration of the curtain rolling up elastic means, their supports, and the connection system between the roller support shaft and the rolling up elastic means.

DESCRIPTION OF THE PRIOR ART

These curtains, commonly called roller or roll up curtains, are usually wound on a roller, which is rotatably supported, in horizontal position, inside a box-like casing situated in the region of the window inner upper edge.

The roller can rotate axially for curtain unrolling and subsequent rolling up.

Amongst all the types of roller curtains, there are two groups of them distinguished according to the unrolling and rolling mechanism type. One of these types includes elastic means, usually a helical spring situated inside the winding roller and fastened thereto, so that unrolling rotation determines its torsion and consequent elastic reaction can be used later for rolling up the curtain.

The curtain is unrolled by directly pulling it downwards and then suitable locking means keep it in the desired position until it is to be rolled up.

Another type of curtain does not include elastic means and is operated manually also for rolling it up.

A small pulley is fastened to the roller head and has a suitably shaped groove into which an operating chain fits for unrolling and rolling up the curtain.

In the first type of curtain, one end of the elastic means is rigidly fastened to the roller while the other end is fixed to the window frame, so that the elastic means are stressed in relation to the curtain unrolling.

According to known techniques, in order to avoid spring undulation, one of its extremities is fastened to a longitudinally moving element situated inside the roller, which rotates along with the roller.

Nevertheless, it is obvious that in case of curtains of a certain length, reaching the end of the unrolling stroke will require a high number of turns of the roller, and spring elastic reaction and torsional stress will be considerable.

This fact provokes problem in dimensioning of the springs to be used which anyway do not return an elastic reaction that fits the necessary strength for rolling up the curtain in a uniform way.

Moreover, the supports of the rolling up spring must be adequate for the elastic reaction to be determined and this increases the dimension of the supports and the global cost of the curtain production.

Furthermore, montage of the rolling up assembly is complicated, since the assembly includes the coupling element between the roller and one extremity of the rolling up spring, the spring, and a shaft which passes through the whole roller and fastens the other extremity of the spring to the casing containing the curtain.

All these elements must be assembled inside the roller and adapted to its transversal dimension, which corresponds to the curtain width.

Therefore, the spring tension problem becomes important when a long and narrow curtain must be unrolled and rolled up, because the length of the spring will not be adequate and thus it will be excessively stressed.

In case of curtains operated completely manually, called also friction curtains, the lack of the elastic reaction determines the necessity of considerable strength for rolling the curtain up, a strength which increases in relation to the length of the curtain unrolled.

To cope with this problem, the diameter of the driving pulley must be large to allow curtain rolling up and unrolling with a reduced effort, also for reducing the size of the operating chain. However, the support dimensions must be determined on the basis of the torque which is created in the regions of the ends of the roller. This has effect on the global dimension of the casing containing the curtain.

Another problem encountered with the conventional friction curtain devices is that the unrolling and rolling up device must have the possibility of being positioned either on one side or on the other side of the window frame to which the curtain is mounted, in accordance with the features of the environment where the curtain is mounted.

To obtain this result two possible ways can be followed in the prior art. According to a first way both the components of the rolling up system and the components of either one or the other series are used in accordance with the necessity.

According to the second way only the rolling up spring are produced in two diverse series, having the same elastic constant but winding in opposite directions.

As it can be easily understood, this fact determines a considerable problem, and production of the roller curtains in both the ways as well as distribution and storing thereof cause high costs. Also maintenance operation of the curtains produced in both the ways just described is complicated and expensive.

The paten specification GB 222,936 to J. Hartley and G. R. Thornborough, disclosed improved means for securing and mounting spiral springs used in revolving shutters and the like. To afford more power for rising or lowering the shutter, the improved means include cylindrical cores or blocks made in two (or more) diameters and each diameter is spirally grooved so as to receive a respective spring.

This allows to mount two (or more) springs to roll up the shutter, and the springs are connected to the roller at one side, by means of a core, and to the internal shaft at the other side, by means of a block.

The object of the present invention is to propose improved elastic means, which return elastic reaction in a more gradual way and adequately to the effective force necessary to roll up the curtain as it is unrolled from the roller.

Another object of the present invention is to propose elastic means of limited dimensions so as to form an assembly which can be rapidly and easily introduced inside the roller independently from the length of the roller. This is obtained by means of a suitable coupling device, which not only locks one extremity of the elastic means to the roller so as to load them elastically, but also reduces the torsion entity, to which they are subjected as the roller is rotated.

The previously mentioned features not only improve the curtain working, but also reduce the global production cost.

Another object of the present invention is to improve the connection means which join the elastic means to the roller and to the roller supporting shaft in a way such that mirror-like relocation of the roll up device, on each side of the window to which the roller curtain is to be mounted, becomes easy and quick, without any need of replacement or double set production.

SUMMARY OF THE INVENTION

These objects are obtained by use of the elastic means for automatically rolling up a roller curtain, or respectively for compensating for the weight of friction curtains during manual rolling up thereof, with the roller rotatably supported in horizontal position by a stationary frame, wherein the elastic means include a plurality of helical springs, which at one extremity are rigidly fastened to a common support connected to said shaft, and with the other extremity of each helical spring fastened to a respective support and constraint element, geometrically coupled to the roller.

The common support is formed by a step tapered cylinder defining stepped sections, with each spring press-fitted to a corresponding section.

Each support and constraint element includes a cylinder, to which a spring is fastened, a raised edge which engages geometrically with the internal surface of the roller, and a cavity made axially in the cylinder, into which a spring of a smaller diameter enters.

The shaft is connected with the stationary frame by interposition of a speed reducer which determines a torsion entity of the elastic means reduced with respect to the actual rotation of the roller.

The speed reducer, together with the group of springs, their supports, the shaft and the external support cylinder body form a compact assembly, which is introduced into the roller.

Geometrical connection between the shaft and the common spring support is obtained by means of connection-driving means including splines made on the shaft and matching a splined hole made in the support so that the shaft can slide therein thus allowing removal and relocation thereof.

BRIEF DESCRIPTION OF THE DRAWINGS

The characteristic features of the invention will be pointed out in the following description, with particular reference to the enclosed drawings, in which:

FIG. 2 shows a section view of a head of the roller with joined thereto a coupling mechanism described in the following;

FIGS. 3 and 4 show two section views taken along planes III—III and IV—IV of FIG. 2;

FIG. 8 shows a section view of a head of the roller, with joined thereto the elastic means coupling mechanism of a friction curtain;

FIGS. 9 and 10 show two section views taken along planes IX—IX and X—X of FIG. 2.

BEST MODES OF CARRYING OUT THE INVENTION

Figure 1:
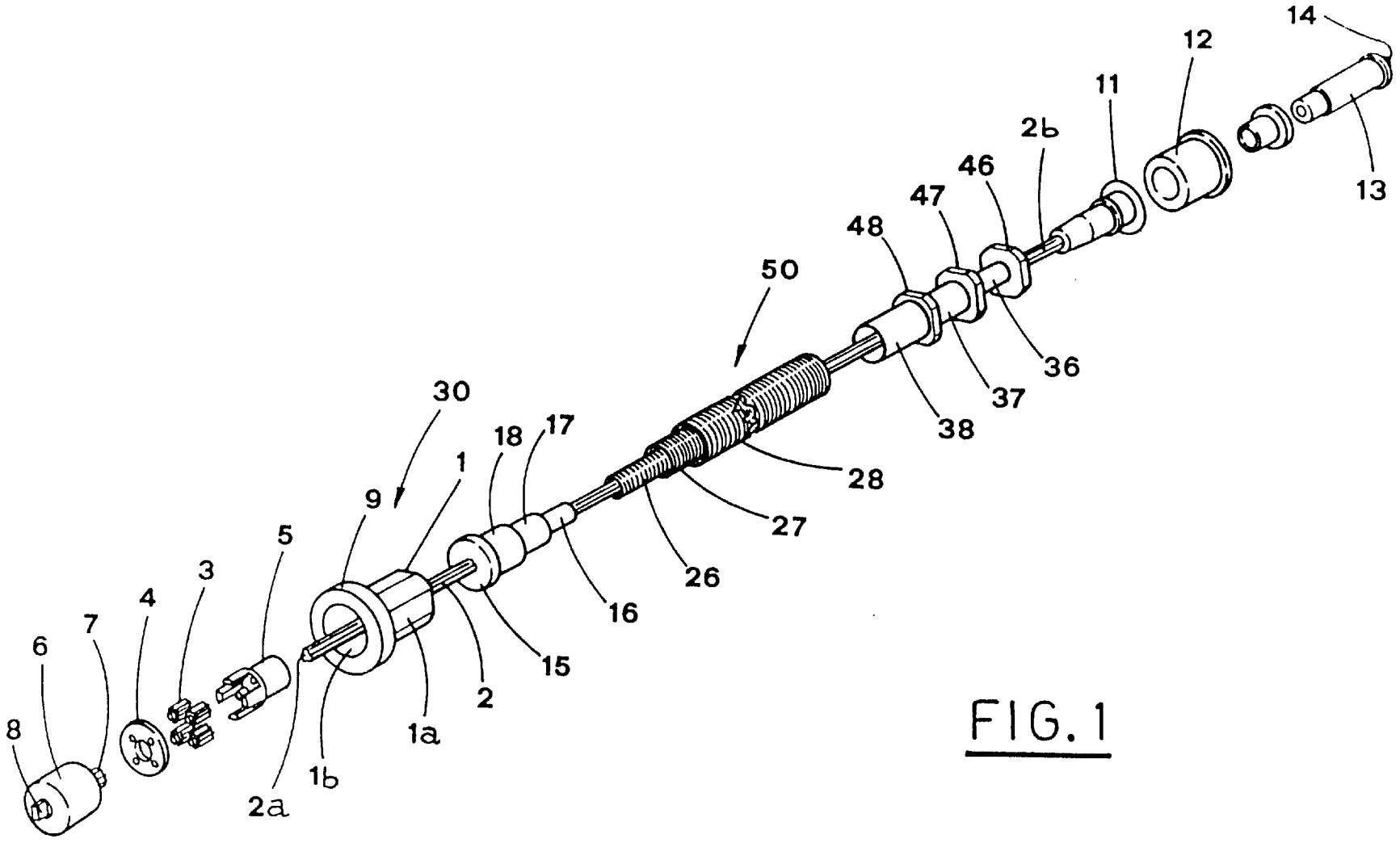
FIG. 1 shows an exploded view of a curtain rolling up system, according to the present invention.

The rolling up elastic means, described in the following, can be used with both types of curtains, either rolling up with a rolling up spring or friction curtains. In the latter case, the elastic means compensate for the curtain weight.

Nevertheless, to simplify the description, the reference will be made to the rolling up curtain using a rolling up spring.

With reference to FIGS. 1, 5, 6 and 7, the roller 19, on which the curtain 20 is rolled up, is rotatably supported in horizontal position, by a stationary element 35, to which one extremity of the elastic means is connected by a shaft 2, extending inside the roller, via a coupling reducer device 30, described in the following.

The other extremity of the elastic means 50 is fastened directly to the roller 19 and is rotated along with the roller, as described below.

The elastic means 50 include a plurality of helical springs 26, 27, 28, e.g. three. Obviously, the number of springs can be any, within the range imposed by the dimensions of the roller 19 and the size of the springs to be used.

In the region of a common end, the springs 26, 27, 28 are rigidly fastened to a common support 15 connected to the shaft 2. Geometrical connection between the shaft 2 and the common spring support 15 is obtained by means of connection-driving means including splines made on the shaft and matching a splined hole made in the support 15 which can thus slide along the shaft.

Figure 5:
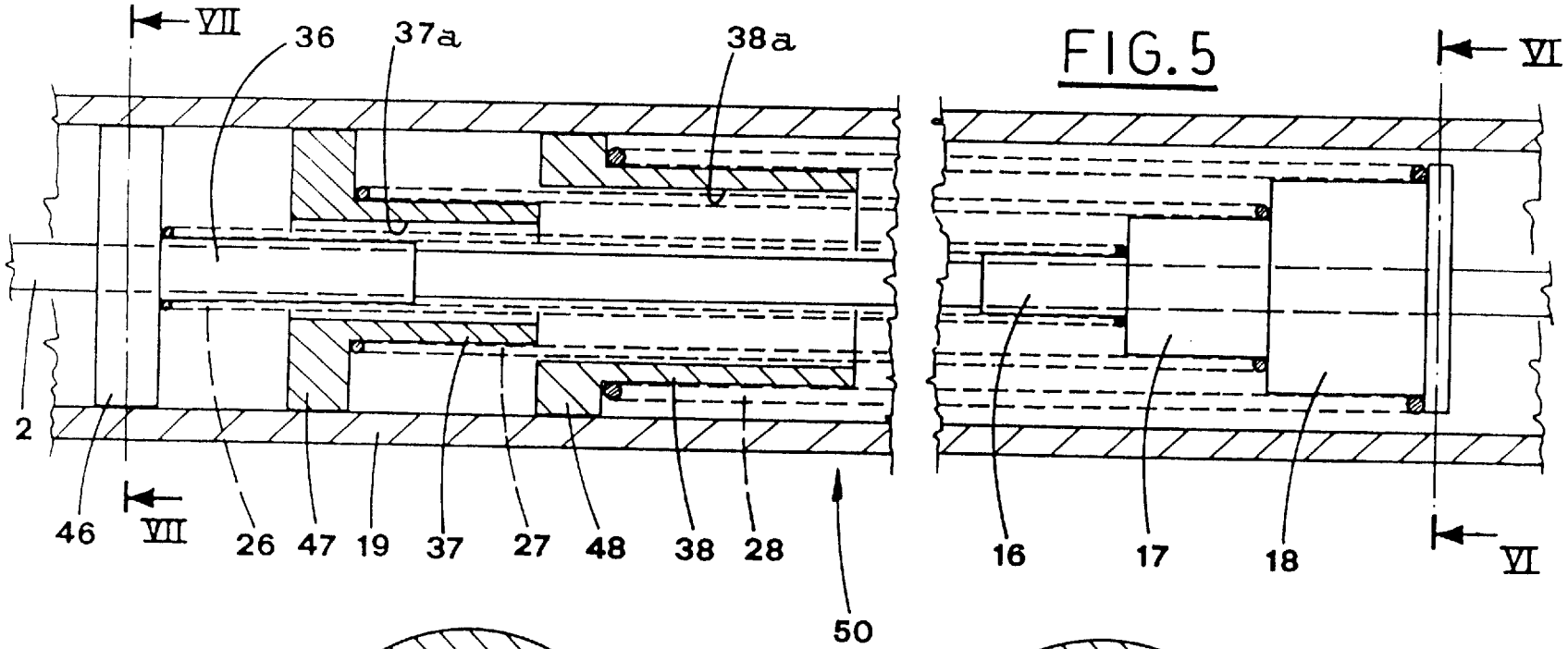
FIG. 5 shows a section view of two non contiguous parts of the roller equipped with rolling elastic means being the subject of the present invention.
Figure 6:
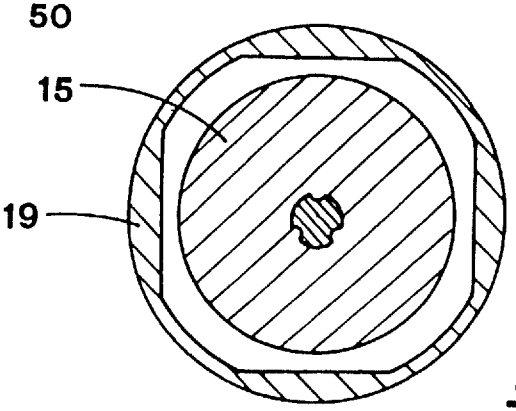
FIGS. 6 and 7 show transversal section views of the roller taken along planes VI—VI and VII—VII of FIG. 5.
Figure 7:
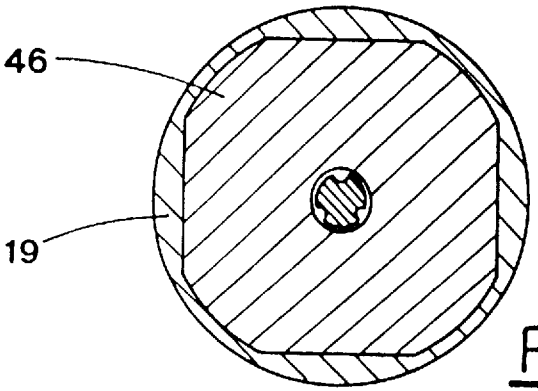

With reference to FIG. 5, the common support 15 includes a step-tapered cylinder forming stepped sections 16, 17, 18. Each spring is press-fit to a corresponding section.

The other extremities of the helical springs 26, 27, 28 are fastened to respective support and restraint elements 36, 37, 38 introduced inside the roller 19 in geometrical coupling therewith.

Each of the support and restraint elements 36, 37, 38 includes a cylinder, on which a respective spring is fastened, a raised edge 46, 47, 48 which engages geometrically with the internal surface 19*a* of the roller 19 and of a cavity 38*a*, 37*a* made axially in the respective cylinder 38, 37 so as to allow the passage of a spring of a smaller diameter.

These elastic means allow to use springs of different dimensions and different elastic constants instead of the single spring used in traditional roller curtains.

Therefore, it is possible to determine selectively the entity of elastic reaction of each spring, thus adjusting the elastic reaction of the group of springs more precisely.

An elastic reaction is thus obtained which is softer and set more gradually during the curtain unrolling.

With separate support elements for each spring, it is possible to mount springs very different in length, or pre-load, e.g. one or more springs in opposite direction with respect to the others, thus determining their operation only from a predetermined point of the curtain unrolling on.

This result can be improved if the shaft 2 is fastened to reducer 30 which is connected to the stationary element 35 and to the roller 19.

The resulting advantage is that the elastic reaction of the springs is kept within a more limited range of values thus corresponding more precisely to the unrolled curtain weight gradually increasing as the curtain unrolls.

With reference to figures from 1 to 7, the device 30 includes a cup element 1, partially introduced into a head of the roller 19, so that its cavity is turned outside.

The external surface 1*a* of the cup element 1 matches the internal surface 19*a* of the roller 19, as appears evident from FIG. 3, so that rotation of the roller determines also rotation of the cup element 1.

The cavity 1*b* of the cup element 1 features an internal ring gear 21 and has a concentric through hole made in its bottom, through which the shaft 2 passes freely.

The device includes also a plurality of planetary gears 3, supported, so as to engage the ring gear 21, by a spider member, or planet carrier, 5 with a concentric hole 5*a*, inside which the extremity of the shaft 2, opposite to the one fastened to the elastic means 50, is introduced with geometrical coupling.

The shaft is blocked inside the hole by fixing screw means of known type, or by glue.

The planet carrier 5 is combined with a perforated plate 4 that keeps the planetary gears 3 in their positions on respective support pins.

Finally, the roller is supported externally by a cylindrical body 6, fastened in a firm position to the stationary element 35 by a geometrical coupling with its shank 8.

The cylindrical body 6 is inserted into the cavity 1*b* of the cup element 1, with possibility of reciprocal rotation, and features a toothed protrusion 7 extending axially, which is introduced between the planetary gears 3, thus forming the sun gear of the planetary gear train including, beside the toothed protrusion 7, the planetary gears 3 and the internal ring gear 21, as is well seen in FIG. 3.

The so far described elements are housed in the cup 1 which is introduced in the head of the roller 19.

FIGS. 8, 9 and 10 show the same device mounted to a friction curtain, which is unrolled and rolled up by a chain 22, fitting into a shaped groove of a small pulley 9 made on the most external edge of the cup element 1.

Operation of the device will be described in the following.

When the curtain is unrolled from the roller by the direct action of a string which is pulled in the direction T, see FIG. 4 for the automatic rolling up curtain, or by pulling a chain 22 mounted on the pulley 9 of the cup element 1, rotation of the roller 19 determines the torsion of the extremity of the elastic means 50 fastened thereto, but at the same time, it rotates also the cup element 1, so that the ring gear 21 determines rotation of the planetary gears 3 with respect to a sun wheel formed by the toothed protrusion 7.

Consequently, the planet carrier 5 is rotated with angular displacements reduced with respect to those of the roller 19.

The planet carrier transmits the rotation movement to the shaft 2, which acts on the springs 26, 27, 28 via the common support 15 with reduced entity with respect to the rotation of the roller 19, that acts directly on the support and constraint elements 36, 37, 38.

Since the rotation directions of these members are the same, the elastic means 50 will be subjected to a reduced torsional stress, that corresponds to the difference in angular displacements, i.e. corresponds to the reduction rate imposed by the coupling device 30.

All this allows to use the same torsional entity of the elastic means 50 along an unrolling path more extended than with the conventional curtain roll up devices.

This means that normal length curtains equipped with the subject device will require a torsional stress reduced with respect to curtains equipped with conventional roll up devices.

The shaft 2 has a size such that its end remains near the most external support and constraint element, and in this point it is provided with a coaxial disc 11 or another element of almost cylindrical section, which keeps the shaft 2 concentric with respect to the roller 19.

A considerable advantage deriving from use of the group of springs 50 co-operating with the elastic means coupling device 30 lies in the possibility to reduce the springs length.

This, together with the fact that the shaft 2 does not pass through the whole roller as in traditional curtains, allows to dramatically reduce the length of the whole group and make it independent from the roller 19 length.

In fact, the coupling device 30 together with the elastic means 50 and the shaft 2 form a compact and small group, which is introduced in the region of a head of any winding roller, independently from its length.

The other head of the roller 19 accommodates a cap 12, rotatably mounted to a cylindrical support 13, featuring a tang 14, similar to the shank of the cylindrical body 6, engaging with a corresponding receiving seat suitably made in the stationary frame for supporting the roller 19.

The cap 12 carries means for reversible locking of the curtain in any position which it must assume and maintain when it is un rolled.

This allows to use the same rolling up mechanism for curtains and rollers of different width, giving the components bigger versatility.

Obviously, the compact form of the rolling up system allows it to be applied also to friction curtains, operated manually also for rolling up the curtain by means of a chain 22 (FIG. 10), acting in this case only as compensation for the curtain weight which increases as the curtain is unrolled from the roller 19.

The rolling up system of the present invention allows easy and quick mirror-like relocation of the roll up device, on each side of the window to which the roller curtain is to be mounted. To re-locate the rolling up device the following operations must be carried out.

Firstly, the coupling reducer device 30 is removed from the shaft 2 so that the spider member 5 is set free and taken away from the shaft 2. Also the pulley 9 is removed from the shaft. Then, the shaft 2 is withdrawn from the elastic means 50 with a simple sliding movement, so that the shaft end 2*a* comes out beside the roller coupled support cylinders 36,37, 38.

The shaft 2 is inserted again with the end 2*a* into the elastic means 50 on the opposite side, i.e. into the common support 15. Lastly, the pulley 9 and the spider support 5 can be mounted again onto the shaft 2, in the region of the end 2*a*, that has taken the place of the end 2*b* of the shaft 2, which carries the coaxial disc 11.

Therefore, another advantage of the present invention is that in friction curtains the roll up system can be indifferently located either on the left or on the right side of the curtain casing by simple relocation thereof, without necessity of production of doubled set assemblies which are to be chosen upon montage.

Also storing room of the necessary components is reduced since the same assembly can be mounted with the roll up system on one side or on the other side.

It is understood that the subject invention has been described, with reference to the enclosed drawings, as a mere, not limitative example, therefore possible variants resulting from practice and use are protected by the present invention as described above and claimed hereinafter.

What is claimed is:

1. A device for rolling up a curtain comprising:

a roller rotatably supported in a horizontal position by a stationary frame, the roller having a shaft, a common support connected to the shaft through a geometrical engagement, elastic means including a plurality of helical springs, each having a first extremity rigidly fastened to the common support, and each having a second extremity fastened to a respective support and constraint element each coupled in a shape mating manner to the roller, said common support being a step tapered cylinder defining stepped sections, each helical spring press-fitted to a corresponding section, each support and constraint element having a cylinder to which the respective second helical spring extremities are fastened, a raised edge engaged geometrically with an internal surface of the roller, and each support and constraint cylinder having a cavity made axially therethrough.

2. The device according to claim 1, further comprising a speed reducer connected between the shaft and the stationary frame, the speed reducer reducing torsional stress with respect to the rotation of the roller.

3. The device according to claim 2, wherein a compact assembly for combination with the roller comprises the speed reducer assembled with the elastic means, the common support, the support and constraint elements, the shaft and an external support cylindrical body, the compact assembly having a length which is independent of the length of the roller.

4. The device according to claim 3, wherein the speed reducer has a cup element introduced at least partly into a head of the roller, the cup element having a cavity facing outwardly relative to the roller, the cup element geometrically coupled with the roller, an internal ring gear located inside the cavity, the cup element having a through hole for receiving the shaft therein, a plurality of planetary gears supported on a planet carrier, and engaged to the ring gear, the planet carrier having a concentric hole which receives an end of the shaft therein, the shaft being geometrical coupled thereto, the external support cylindrical body fastened rigidly to the stationary frame, and having a toothed protrusion extending axially between the planetary gears for engagement therewith to form a sun wheel of a planetary gear train.

5. The device according to claim 2, further comprising a co-axial disk, rotatably fastened to the shaft for keeping the shaft concentric with respect to the roller.

6. The device according to claim 1, wherein the geometrical engagement between the shaft and the common support comprises splines made on the shaft engaged to a hole having mating splines made in the support so that the shaft can slide therein to allow removal and relocation thereof.

* * * * *